US009501974B2

(12) United States Patent
Kwon et al.

(10) Patent No.: US 9,501,974 B2
(45) Date of Patent: Nov. 22, 2016

(54) ORGANIC LIGHT-EMITTING DISPLAY APPARATUS

(71) Applicant: SAMSUNG DISPLAY CO., LTD., Yongin, Gyeonggi-Do (KR)

(72) Inventors: Ohjo Kwon, Yongin (KR); Choongsun Shin, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/723,260

(22) Filed: May 27, 2015

(65) Prior Publication Data

US 2016/0203760 A1 Jul. 14, 2016

(30) Foreign Application Priority Data

Jan. 12, 2015 (KR) ..... 10-2015-0004457

(51) Int. Cl.
*G09G 3/3233* (2016.01)
*G09G 3/32* (2016.01)

(52) U.S. Cl.
CPC ..... *G09G 3/3233* (2013.01); *G09G 3/3275* (2013.01); *G09G 2310/027* (2013.01); *G09G 2310/0289* (2013.01); *G09G 2310/0291* (2013.01); *G09G 2320/045* (2013.01); *G09G 2330/12* (2013.01)

(58) Field of Classification Search
CPC .... G09G 3/3233; G09G 3/3275; G09G 5/18; G06F 3/0412
USPC ..... 345/214
See application file for complete search history.

(56) References Cited

U.S. PATENT DOCUMENTS 4,218,675 A * 8/1980 Shaw ..... H03M 1/447 341/156
8,084,727 B2 * 12/2011 Rostaing ..... G01J 1/44 250/208.1
2009/0303172 A1 12/2009 Park et al.
2011/0012519 A1 * 1/2011 Zhao ..... H03M 1/1235 315/185 R
2012/0105264 A1 5/2012 Ryu et al.
2013/0221856 A1 * 8/2013 Soto ..... G06F 3/0412 315/152

(Continued)

FOREIGN PATENT DOCUMENTS

KR 10-2009-0128255 A 12/2009
KR 10-2012-0046619 A 5/2012

(Continued)

*Primary Examiner* — Fred Tzeng
(74) *Attorney, Agent, or Firm* — Lewis Roca Rothgerber Christie LLP

(57) ABSTRACT

An organic light-emitting display apparatus including a display including pixels arranged in an array, a sensor for detecting respective current characteristics of the pixels, a current sensor for receiving a first current from a first pixel of the pixels, for outputting a first voltage corresponding to the first current, for receiving a second current from a second pixel of the pixels, and for outputting a second voltage corresponding to the second current, a level shifter for receiving the first and second voltages and for generating first and second shift voltages respectively corresponding to the first and second voltages, an intermediate voltage of the first and second voltages being equal to a conversion reference voltage, and an analog-to-digital converter for receiving the first and second shift voltages and for outputting a digital value corresponding to a difference between the first and second shift voltages based on the conversion reference voltage.

20 Claims, 8 Drawing Sheets

(56) References Cited

U.S. PATENT DOCUMENTS

| | | | | |
|---|---|---|---|---|
| 2014/0160094 | A1 | 6/2014 | Jo | |
| 2015/0130780 | A1 | 5/2015 | Kwon et al. | |
| 2015/0364114 | A1* | 12/2015 | Smith | G09G 5/18 345/213 |

FOREIGN PATENT DOCUMENTS

| | | | |
|---|---|---|---|
| KR | 10-2013-0015859 | A | 2/2013 |
| KR | 10-2014-0076023 | A | 6/2014 |
| KR | 10-2015-0055786 | | 5/2015 |

* cited by examiner

ORGANIC LIGHT-EMITTING DISPLAY APPARATUS

CROSS-REFERENCE TO RELATED APPLICATION

This application claims priority to and the benefit of Korean Patent Application No. 10-2015-0004457, filed on Jan. 12, 2015, in the Korean Intellectual Property Office, the disclosure of which is incorporated herein in its entirety by reference.

BACKGROUND

1. Field

Aspects of one or more exemplary embodiments relate to an organic light-emitting display apparatus, and more particularly, to an organic light-emitting display apparatus in which current characteristics of pixels may be accurately detected.

2. Description of the Related Art

An organic light-emitting display apparatus includes thin film transistors (TFTs) to drive pixels. Although in an ideal case all of the TFTs should have the same characteristics, the TFTs may have different characteristics due to variations that occur during the manufacturing process. For example, the characteristics of the TFTs may be different from each other due to variables such as an aspect ratio or a source-drain voltage, which vary according to the manufacturing process. Also, the characteristics of the TFTs and the characteristics of the organic light-emitting apparatus may change due to deterioration. Due to these problems, an operation of accurately displaying colors for example, may not be performed as intended. In order to solve these problems, it is desirable to accurately detect the current characteristics of TFTs and organic light-emitting devices (OLEDs) included in the pixels.

SUMMARY

Aspects of one or more exemplary embodiments are directed to an organic light-emitting display apparatus in which current characteristics of pixels may be accurately detected.

Additional aspects will be set forth in part in the description which follows and, in part, will be apparent from the description, or may be learned by practice of the presented exemplary embodiments.

According to one or more exemplary embodiments, there is provided an organic light-emitting display apparatus including: a display including a plurality of pixels arranged in an array; a sensor configured to detect respective current characteristics of the plurality of pixels; a current sensor configured to receive a first current from a first pixel of the plurality of pixels, to output a first voltage corresponding to the first current, to receive a second current from a second pixel of the plurality of pixels, and to output a second voltage corresponding to the second current; a level shifter configured to receive the first and second voltages and to generate first and second shift voltages respectively corresponding to the first and second voltages, an intermediate voltage of the first and second voltages being equal to a conversion reference voltage; and an analog-to-digital converter (ADC) configured to receive the first and second shift voltages and to output a digital value corresponding to a difference between the first and second shift voltages based on the conversion reference voltage.

In an embodiment, each of the first and second pixels includes a pixel circuit including a first node, and an organic light-emitting device (OLED) connected to the pixel circuit, and the pixel circuit includes a driving transistor configured to output a driving current to the OLED via the first node.

In an embodiment, the first current includes a current output from the driving transistor of the first pixel to the first node.

In an embodiment, the first current includes a current flowing in the OLED of the first pixel when a first reference voltage is applied to the first node of the first pixel.

In an embodiment, the second pixel is in an inactive state and the second current includes a noise component.

In an embodiment, the current sensor includes a first integrator configured to integrate the first current to output the first voltage, and a second integrator configured to integrate the second current to output the second voltage.

In an embodiment, each of the first and second integrators includes an operational amplifier including a first input terminal and a capacitor, and a first reference voltage is applied to the first input terminal, and the capacitor is connected between a second input terminal of the operational amplifier and an output terminal.

In an embodiment, the level shifter includes a first capacitor and a second capacitor, and the first capacitor is configured to store a difference between the first voltage and the intermediate voltage, and the second capacitor is configured to store a difference between the second voltage and the intermediate voltage.

In an embodiment, the conversion reference voltage is selectively applied to a node between the first and second capacitors.

In an embodiment, the level shifter includes a voltage distributor configured to output the intermediate voltage, and the voltage distributor includes two ends to which the first and second voltages are respectively applied.

In an embodiment, the level shifter includes a first capacitor and a second capacitor, and the first capacitor is configured to store a difference between the first shift voltage and the conversion reference voltage, and the second capacitor is configured to store a difference between the conversion reference voltage and the second shift voltage.

In an embodiment, the level shifter includes a voltage distributor configured to output a first proportional voltage, the intermediate voltage, and a second proportional voltage, the voltage distributor includes two ends to which the first and second voltages are respectively applied, and a difference between the first proportional voltage and the intermediate voltage is stored in the first capacitor, and a difference between the intermediate voltage and the second proportional voltage is stored in the second capacitor.

In an embodiment, an input range of the ADC is set based on the conversion reference voltage.

In an embodiment, the apparatus further includes a reference voltage generator configured to generate a first reference voltage applied to the first node and the conversion reference voltage.

In an embodiment, the sensor includes the current sensor, the level shifter, the ADC, and the reference voltage generator.

In an embodiment, the display further includes a plurality of data lines connected to the plurality of pixels, and the current sensor is configured to receive the first and second currents via corresponding ones of the data lines connected to the first and second pixels.

In an embodiment, the apparatus further includes: a data driver configured to supply data signals to the plurality of pixels via the plurality of data lines; and a switching unit including first switches connected between the data driver and the plurality of data lines, and second switches connected between the sensor and the plurality of data lines.

According to one or more exemplary embodiments, there is provided an organic light-emitting display apparatus including: a current sensor configured to output a first integration voltage corresponding to a first current received at a first input terminal and a second integration voltage corresponding to a second current received at a second input terminal; a level shifter configured to receive the first and second integration voltages and generate first and second shift voltages respectively corresponding to the first and second integration voltages, an intermediate voltage of the first and second integration voltages being equal to a conversion reference voltage; and an analog-to-digital converter (ADC) configured to receive the first and second shift voltages and to output a digital value corresponding to a difference between the first and second shift voltages based on the conversion reference voltage.

In an embodiment, the current sensor includes a first integrator configured to integrate the first current based on a first reference voltage as an initial value and to output the first integration voltage, and a second integrator configured to integrate the second current based on the first reference voltage as an initial value and to output the second integration voltage.

In an embodiment, the apparatus further includes a reference voltage generator configured to generate the first reference voltage and the conversion reference voltage.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
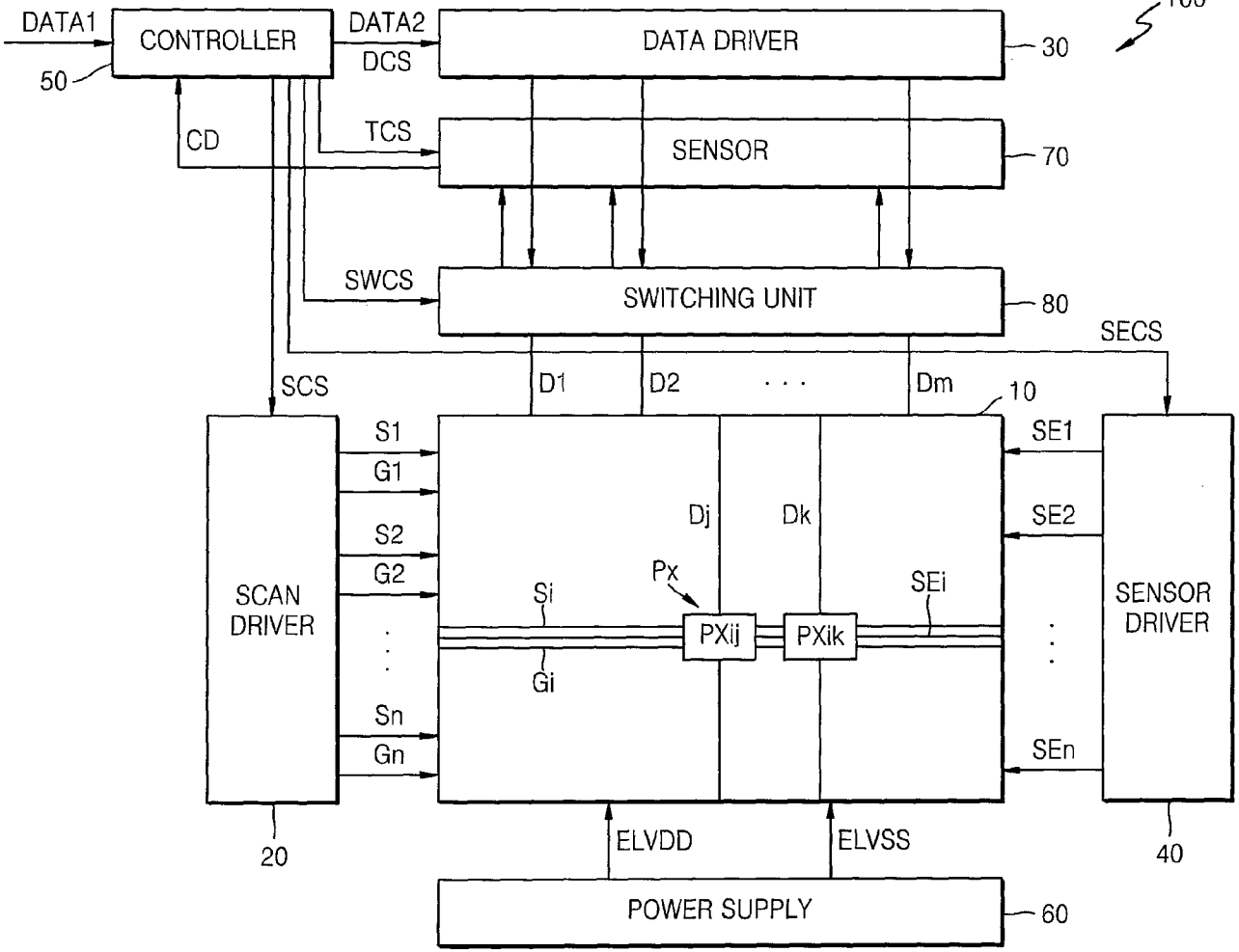
FIG. 1 is a block diagram illustrating an organic light-emitting display apparatus according to an exemplary embodiment of the present invention.

As the inventive concept allows for various changes and numerous embodiments, particular embodiments will be illustrated in the drawings and described in detail in the written description. The effect and features of the inventive concept and the method of realizing the effect and the features will be clear with reference to the exemplary embodiments described in detail below with reference to the drawings. However, the inventive concept may be embodied in various forms and should not be construed as being limited to the exemplary embodiments.

Hereinafter, the exemplary embodiments will be described in detail with reference to the drawings. In order to clearly describe the present inventive concept, elements and features that are not essential to the understanding of the present inventive concept may be omitted. Like reference numerals refer to like elements in the drawings, and thus, descriptions of similar or identical elements may not be repeated.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. §112, first paragraph, and 35 U.S.C. §132(a).

The organic light-emitting display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the [device] may be formed on one integrated circuit (IC) chip or on separate IC chips. Further, the various components of the organic light-emitting display apparatus may be implemented on a flexible printed circuit film, a tape carrier package (TCP), a printed circuit board (PCB), or formed on a same substrate. Further, the various components of the organic light-emitting display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

FIG. 1 is a block diagram illustrating an organic light-emitting display apparatus 100 according to an exemplary embodiment of the present invention.

Referring to FIG. 1, the organic light-emitting display apparatus 100 includes a display 10 and a sensor 70. The organic light-emitting display apparatus 100 may further include at least one selected from a scan driver 20, a data driver 30, a sensing driver 40, a controller 50, a power supply 60, and a switching unit 80.

A plurality of pixels PX is arranged in an array in the display 10. Each of the pixels PX include an organic light-emitting device (OLED) (e.g., OLED of FIG. 3) and a driving transistor (e.g., Md of FIG. 3) that supplies a driving current to the OLED. The OLED and the driving transistor are connected to each other via a first node (e.g., N1 of FIG. 3). The pixels PX will be described in further detail below with reference to FIG. 3.

Two pixels (PXij and PXik) are illustrated in FIG. 1 as an example. It will be understood by one of ordinary skill in the art that more than two (e.g., m×n; m and n being integers greater than 0) pixels PX may be located in the display 10. In the present specification, the pixels (PXij and PXik) may be referred to as a first pixel PXij and a second pixel PXik. The first pixel PXij and the second pixel PXik are illustrated as being located in the same row, but are not limited thereto. The first and second pixels PXij and PXik may be located in different rows.

Each of the pixels PX may be connected to scan lines S1 to Sn and gate lines G1 to Gn connected to the scan driver 20, sensor lines SE1 to SEn connected to the sensing driver 40, and data lines D1 to Dm selectively connected to the data driver 30 and the sensor 70. The first pixel PXij may be connected to a corresponding scan line Si from among the scan lines S1 to Sn, a corresponding gate line Gi from among the gate lines G1 to Gn, a corresponding sensor line SEi from among the sensor lines SE1 to SEn, and a corresponding data line Dj from among the data lines D1 to Dm. The second pixel PXik may be connected to a corresponding scan line Si from among the scan lines S1 to Sn, a corresponding gate line Gi from among the gate lines G1 to Gn, a corresponding sensor line SEi from among the sensor lines SE1 to SEn, and a corresponding data line Dk from among the data lines D1 to Dm.

Figure 4:
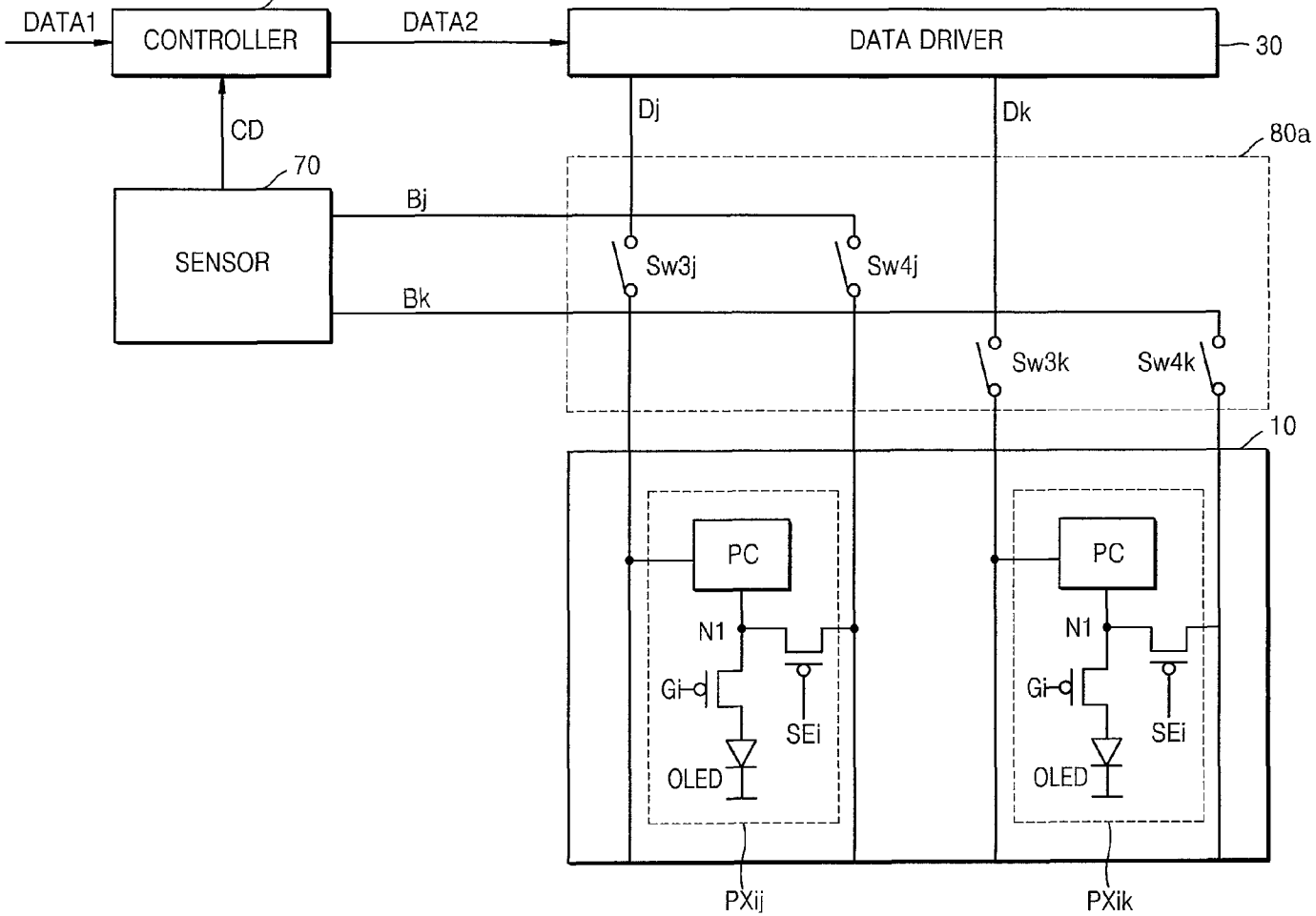
FIG. 4 is a schematic block diagram illustrating some components of an organic light-emitting display apparatus according to another exemplary embodiment of the present invention.

Alternatively, the pixels PX may be connected to the data driver 30 via the data lines D1 to Dm, and connected to the sensor 70 via connection lines (e.g., Bj and Bk of FIG. 4). An embodiment in which the pixels PX are connected to the sensor 70 via the connection lines (e.g., B1 to Bm of FIG. 4) will be described below with reference to FIG. 4.

The pixels PX receive a first power voltage ELVDD and a second power voltage ELVSS from the power supply 60. The power supply 60 may supply a first power voltage ELVDD of a high level and a second power voltage ELVSS of a low level to the display 10.

The pixels PX may control an amount of current flowing through the OLED from the first power voltage ELVDD to the second power voltage ELVSS, based on an image data signal received from the data driver 30 via a data line Di. The OLEDs of the pixels PX emit light having a luminance that corresponds to the image data signal.

The scan driver 20 may generate scan signals and gate signals and transmit the scan signals and the gate signals to the pixels PX via the scan lines S1 to Sn and the gate lines G1 to Gn, respectively. The sensing driver 40 may generate sensor signals and transmit the sensor signals to the pixels PX via the sensor lines SE1 to SEn.

The data driver 30 may generate image data signals DATA2 and transmit the image data signals DATA2 to the pixels PX via the data lines D1 to Dm. The controller 50 may receive image signals DATA1 from an external source and generate the image data signals DATA2 based on the image signals DATA1. The controller 50 may generate the image data signals DATA2 based on current data CD provided by the sensor 70.

The sensor 70 may be configured to detect a current characteristic of each of the pixels PX. Herein, a method performed by the sensor 70 to detect a current characteristic of the first pixel PXij will be described. The sensor 70 may detect the current characteristic of the first pixel PXij based on the second pixel PXik. The sensor 70 may detect a current characteristic of a driving transistor of the first pixel PXij or a current characteristic of an OLED of the first pixel PXij. When the sensor 70 detects a first current that is supplied by the first pixel PXij, the first current may include noise components. The sensor 70 may detect a second current supplied by the second pixel PXik in an inactive state, and the second current may include only noise components because there are no signal components that are output from the second pixel PXik. The sensor 70 may remove the noise components of the first current by subtracting the second current from the first current. The operations of the sensor 70 will be described in further detail below with reference to FIG. 2.

The sensor 70 may be connected to the pixels PX via the data lines D1 to Dm. For example, the sensor 70 may be connected to the first pixel PXij via the data line Dj, and connected to the second pixel PXik via the data line Dk. According to another exemplary embodiment, the sensor 70 may be connected to the pixels PX via the connection lines (e.g., Bj and Bk of FIG. 4).

The data driver 30 may provide source data signals to the first and second pixels PXij and PXik via the data lines Dj and Dk as a test signal for detecting the current characteristic of the driving transistor of the first pixel PXij. The source data signals may determine a source-gate voltage of the driving transistor.

A source data signal supplied to the first pixel PXij may have a voltage level corresponding to a first gray level (or grayscale level). When the source data signal is transmitted to the first pixel PXij via the data line Di, the first pixel PXij may emit light having a luminance that corresponds to the first gray level. When the image data signals DATA2 are 8-bit signals, the first gray level may be at least one selected from 1 to 255 gray levels, for example, 255 gray level, 128 gray level, 64 gray level, 32 gray level, and 16 gray level.

Because the second pixel PXik is in an inactive state, a source data signal supplied to the second pixel PXik may have a voltage level corresponding to a black gray level (e.g., 0 gray level). When the source data signal is transmitted to the second pixel PXik via the data line Dk, the second pixel PXik may not emit light in response to the black gray level.

The sensor 70 may apply a first reference voltage (e.g., Vref1 of FIG. 3) to a first node of the first pixel PXij, and detect the first current flowing in the driving transistor of the first pixel PXij or the first current flowing in the OLED of the first pixel PXij. Because the first pixel PXij is in an active state, the first current detected by the sensor 70 may include signal components and noise components generated by the driving transistor or the OLED of the first pixel PXij.

The sensor 70 may apply the first reference voltage to a first node of the second pixel PXik and detect the second current flowing in a driving transistor of the second pixel PXik or the second current flowing in an OLED of the second pixel PXik. Because the second pixel PXik is in an inactive state, the second current detected by the sensor 70 may mostly include noise components.

The first reference voltage may be preset as a voltage corresponding to an operation point between the driving transistor and the OLED of the first pixel PXij. The first reference voltage may vary according to a grayscale value (or gray level) of the source data signal provided to the first pixel PXij. The first reference voltage may change to detect voltages and current characteristics of the OLED of the first pixel PXij.

The switching unit 80 may selectively connect the data lines D1 to Dm to the data driver 30 or the sensor 70. For example, when the display 10 displays an image, the switching unit 80 may connect the data lines D1 to Dm to the data driver 30 so that the image data signals DATA2 are applied to the pixels PX. Also, in order to transmit the source data signals to the pixels PX during a test operation, the switching unit 80 may connect the data lines D1 to Dm to the data driver 30. The switching unit 80 may connect the data lines D1 to Dm to the sensor 70 so that a current of a driving transistor or a current of an OLED may be detected by the sensor 70.

The switching unit 80 may include a pair of switching devices connected to each of the data lines D1 to Dm. However, the exemplary embodiments are not limited thereto. The sensor 70 may select some pixels PX from the plurality of pixels PX in the display 10 and detect current characteristics of the selected pixels PX. In this case, the switching devices may be connected to some of the data lines D1 to Dm.

A time when the sensor 70 detects the current characteristics of the pixels PX is not particularly restricted. The detection may be performed each time when power is applied to the organic light-emitting display apparatus 100, or before the organic light-emitting display apparatus 100 is released as a final product. Alternatively, the sensor 70 may automatically operate periodically. Alternatively, the sensor 70 may be set by a user to operate randomly.

The sensor 70 may generate the current data CD that represents the current characteristics of the pixels PX, and provide the current data CD to the controller 50. According to the present embodiment, because the current data CD corresponds to actual estimated data without noise components, the current data CD may accurately represent the current characteristics of the pixels PX. The controller 50 may correct the image signals DATA1 as the image data signals DATA2 based on the current data CD. Thus, the organic light-emitting display apparatus 100 may display relatively more accurate images.

The controller 50 may generate control signals for controlling the scan driver 20, the data driver 30, the sensing driver 40, the sensor 70, and the switching unit 80, and transmit the control signals to the scan driver 20, the data driver 30, the sensing driver 40, the sensor 70, and the switching unit 80.

The controller 50 may transmit scan driver control signals SCS to the scan driver 20. The scan driver control signals SCS may control the operations of the scan driver 20, such as supplying the scan signals to the scan lines S1 to Sn and supplying the gate signals to the gate lines G1 to Gn.

The controller 50 may transmit data driver control signals DCS to the data driver 30. The data driver control signals DCS may control the operations of the data driver 30, such as supplying the image data signals DATA2 and the source data signals to the data lines D1 to Dm.

The controller 50 may transmit sensing driver control signals SECS to the sensing driver 40. The sensing driver control signals SECS may control the operations of the sensing driver 40, such as supplying the sensor signals to the sensor lines SE1 to SEn.

The controller 50 may respectively transmit sensor control signals TCS and switching control signals SWCS to the sensor 70 and the switching unit 80. The sensor control signals TCS may control the operations of the sensor 70, such as output a reference voltage and detecting current flowing in the driving transistor. The switching control signals SWCS may control turn-on operations of the pair of switching devices of the switching unit 80 that selectively connects the sensor 70 and the data driver 30 to the data lines D1 to Dm.

Figure 2:
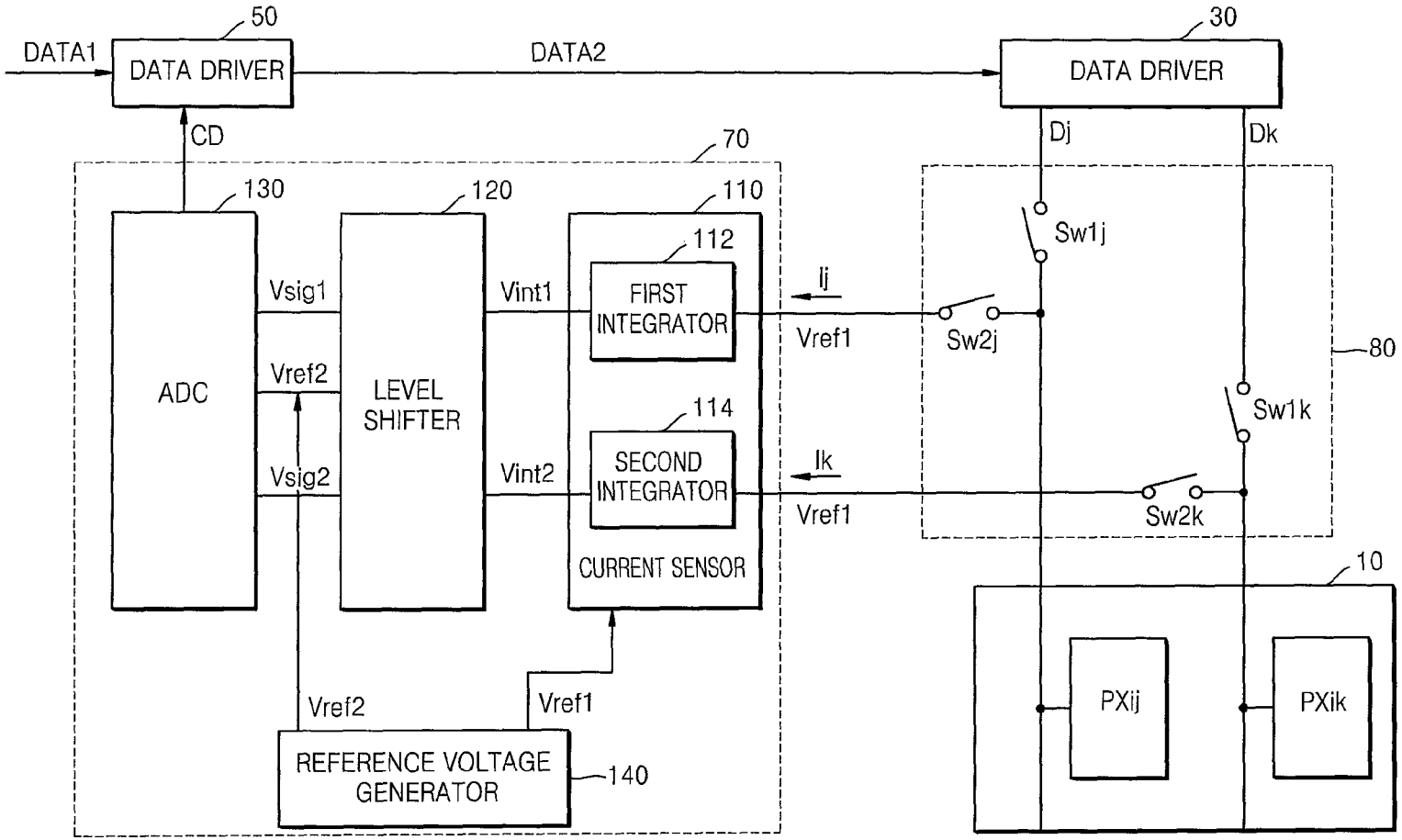
FIG. 2 is a schematic block diagram illustrating some components of the organic light-emitting display apparatus of FIG. 1.

FIG. 2 is a schematic block diagram illustrating some of the components of the organic light-emitting display apparatus 100 of FIG. 1.

Referring to FIG. 2, the display 10 that includes the first and second pixels PXij and PXik, the switching unit 80, the data driver 30, the controller 50, and the sensor 70 are shown. The descriptions of the display 10, the switching unit 80, the data driver 30, and the controller 50 will not be repeated. The operations of the sensor 70 will be described in further detail. The sensor 70 is configured to detect the current characteristic of the first pixel PXij by using the second pixel PXik in the inactive state.

The sensor 70 includes a current sensor 110, a level shifter 120, and an analog-to-digital converter (ADC) 130. The current sensor 110 is configured to receive a first current Ij from the first pixel PXij among the pixels PX, in which a current characteristic of the first pixel PXij is to be detected, and to output a first voltage Vint1 corresponding to the first current Ij. Also, the current sensor 110 is configured to receive a second current Ik from the second pixel PXik among the pixels PX, in which the second pixel PXik is compared with the first pixel PXij, and to output a second voltage Vint2 corresponding to the second current Ik. The level shifter 120 is configured to receive the first and second voltages Vint1 and Vint2 and to generate first and second shift voltages Vsig1 and Vsig2, which respectively correspond to the first and second voltages Vint1 and Vint2, so that an intermediate voltage of the first and second voltages Vint1 and Vint2 is equal to a conversion reference voltage Vref2. The ADC 130 is configured to receive the first and second shift voltages Vsig1 and Vsig2 and to output a digital value CD that corresponds to a difference between the first and second shift voltages Vsig1 and Vsig2 based on the conversion reference voltage Vref2.

The current sensor 110 may include a first integrator 112 and a second integrator 114. The first integrator 112 may receive the first current Ij, integrate the first current Ij based on the first reference voltage Vref1 as an initial value, and thus, generate the first voltage Vint1. The second integrator 114 may receive the second current Ik, integrate the second current Ik based on the first reference voltage Vref1 as an initial value, and thus, generate the second voltage Vint2. The first and second voltages Vint1 and Vint2 may be referred to as a first integration voltage Vint1 and a second integration voltage Vint2, respectively.

The sensor 70 may further include a reference voltage generator 140. The reference voltage generator 140 may generate the first reference voltage Vref1 and the conversion reference voltage Vref2, output the first reference voltage Vref1 to the current sensor 110, and output the conversion reference voltage Vref2 to the level shifter 120 and the ADC 130. The conversion reference voltage Vref2 may be referred to as a second reference voltage. The first reference voltage Vref1 is a voltage corresponding to an operation point of the first pixel PXij and may be applied to a first node. The first reference voltage Vref1 may be applied to a first node of the second pixel PXik as the first pixel PXij.

An input range of the ADC 130 is set based on the conversion reference voltage Vref2. For example, the input range of the ADC 130 may be about 0 to about 2 Vref2. When an input greater than 2 Vref2 is applied to the ADC 130, the ADC 130 outputs a maximum value, which is greatly different from a value normally output. The level shifter 120 may shift the first and second integration voltages Vint1 and Vint2, which are generated by the current sensor 110, to be within the input range of the ADC 130. As another example, the input range of the ADC 130 may be from about −2 Vref2 to about 2 Vref2.

The first current Ij that is input to the current sensor 110 may be the current flowing in the driving transistor of the first pixel PXij or the current flowing in the OLED of the first pixel PXij. When the first current Ij is the current flowing in the driving transistor, the first current Ij flows from the first pixel PXij to the first integrator 112. However, when the first current Ij is the current flowing in the OLED, the first current Ij flows from the first integrator 112 to the first pixel PXij. Therefore, according to a type of the first current Ij that is detected, the first integration voltage Vint1 may be higher or smaller than the first reference voltage Vref1.

The second current Ik is detected with respect to the second pixel PXik after the second pixel PXik is in an inactive state. Because the second pixel PXik does not generate current that includes signal components, the second current Ik may substantially include noise current. The second integration voltage Vint2 obtained by integrating the noise current may be a positive or negative value.

As described above, the first and second integration voltages Vint1 and Vint2 may have a wide range of values. When the input range of the ADC 130 includes all values in the wide range, the accuracy of the ADC 130 may be low. However, according to the present embodiment, even when the first and second integration voltages Vint1 and Vint2 have a wide range of values, the input range of the ADC 130 may be reduced by shifting the first and second integration voltages Vint1 and Vint2 to the first and second shift voltages Vsig1 and Vsig2, and thus the accuracy of the ADC 130 may be increased.

The switching unit 80 may include a pair of selective switches that are connected to data lines Dj and Dk, for example, first selective switches Sw1*j* and Sw1*k* and second selective switches Sw2*j* and Sw2*k*. The first selective switches Sw1*j* and Sw1*k* may be connected between the data driver 30 and the data lines Dj and Dk. When the first selective switches Sw1*j* and Sw1*k* are turned on, the image data signals DATA2 or the source data signals may be transmitted to the first and second pixels PXij and PXik via the data lines Dj and Dk. The second selective switches Sw2*j* and Sw2*k* are connected between the sensor 70 and the data lines Dj and Dk. When the second selective switches Sw2*j* and Sw2*k* are turned on, the first and second currents Ij and Ik respectively supplied from the first and second pixels PXij and PXik may be transmitted to the sensor 70 via the data lines Dj and Dk.

A method of detecting the current characteristic of the driving transistor of the first pixel PXij is as follows. First, the first selective switches Sw1*j* and Sw1*k* of the switching unit 80 are turned on and the second selective switches Sw2*j* and Sw2*k* are turned off by the controller 50. The data driver 30 may output a source data signal corresponding to a first gray level to the first pixel PXij via the data line Dj, and output a source data signal corresponding to the black gray level to the second pixel PXik via the data line Dk.

Next, the first selective switches Sw1*j* and Sw1*k* of the switching unit 80 are turned off and the second selective switches Sw2*j* and Sw2*k* are turned off. The driving transistor of the first pixel PXij may output the first current Ij corresponding to the first gray level, and the first current Ij may be converted to the first integration voltage Vint1 by the first integrator 112 of the current sensor 110. The driving transistor of the second pixel PXik is turned off. The second current Ik includes only noise components, and is converted to the second integration voltage Vint2 by the second integrator 114 of the current sensor 110.

The level shifter 120 may shift the first and second integration voltages Vint1 and Vint2 into the first and second shift voltages Vsig1 and Vsig2, respectively, and the ADC 130 may estimate a difference between the first and second shift voltages Vsig1 and Vsig2. The ADC 130 may output a digital value corresponding to the difference as the current data CD. As described above, the first current Ij includes the signal components of the driving transistor of the first pixel PXij and the noise components, and the second current Ik includes only the noise components. A value obtained by subtracting the second current Ik from the first current Ij corresponds to a signal component of the driving transistor of the first pixel PXij.

Figure 3:
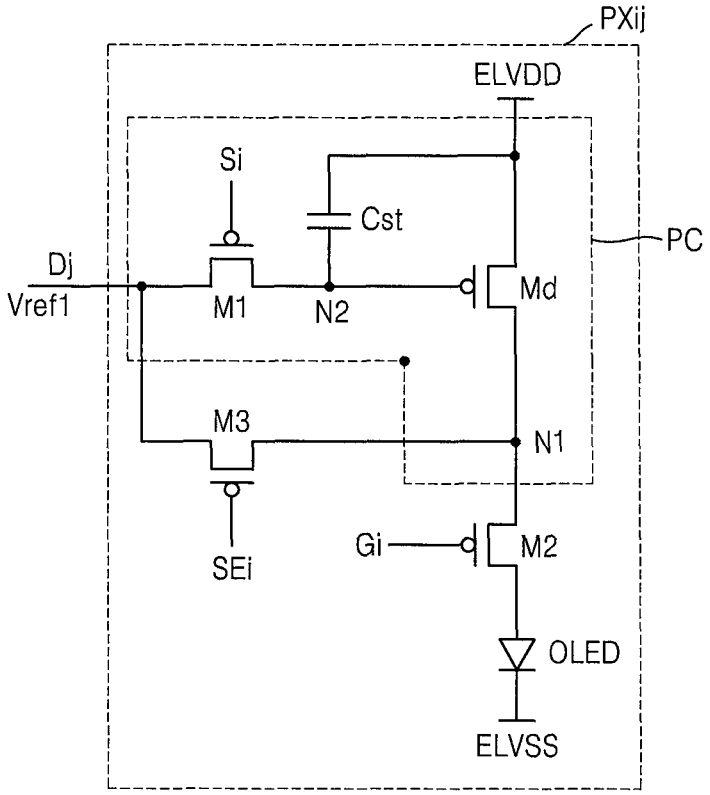
FIG. 3 is a circuit diagram illustrating an example of a pixel of an organic light-emitting display apparatus, according to an exemplary embodiment of the present invention.

FIG. 3 is a circuit diagram illustrating an example of a pixel of the organic light-emitting display apparatus 100, according to an exemplary embodiment of the present invention.

Referring to FIG. 3, an example of a circuit diagram of a pixel PXij, located at an i-th pixel line and a j-th pixel column, is shown among the pixels PX of the display 10. The pixel PXij is connected to an i-th scan line Si, an i-th gate line Gi, an i-th sensor line SEi, and a j-th data line Dj. The pixel PXij receives image data signals and source data signals via the data line Dj.

The pixel PXij includes a pixel circuit PC that includes a first node N1, and an OLED that is connected to the pixel circuit PC via the first node N1. The pixel PXij may include the OLED, a driving transistor Md, a switching transistor M1, a connecting transistor M2, a detection transistor M3, and a storage capacitor Cst. The pixel PXij may include the first node N1 between the driving transistor Md and the connecting transistor M2, and a second node N2 between a gate of the driving transistor Md and the switching transistor M1.

The driving transistor Md may be located between an anode electrode of the OLED and a first power voltage source ELVDD to control an amount of current flowing to a second power voltage source ELVSS from the first power voltage source ELVDD via the OLED. The driving transistor Md may output a driving current to the OLED via the first node N1. The OLED may emit light via the driving current that flows into the anode electrode.

In the driving transistor Md, the gate may be connected to the second node N2, a first electrode may be connected to the first power voltage source ELVDD, and a second electrode may be connected to the first node N1. The gate of the driving transistor Md and the first electrode may be connected to two ends of the storage capacitor Cst, and the driving current that flows from the first power voltage source ELVDD to the OLED may be controlled according to a data voltage stored in the storage capacitor Cst. In this case, the OLED emits light having a luminance that corresponds to an amplitude of the driving current supplied from the driving transistor Md.

In the switching transistor M1, a gate may be connected to the i-th scan line Si, a first electrode may be connected to the j-th data line Dj, and a second electrode may be connected to the second node N2. The switching transistor M1 may transmit a data signal transmitted via the j-th data line Dj to the second node N2, in response to a scan signal transmitted via the i-th scan line Si. The storage capacitor Cst, of which an electrode is connected to the second node N2, may store a voltage corresponding to the data signal transmitted to the second node N2.

Regarding the connecting transistor M2, a gate may be connected to the i-th gate line Gi, a first electrode may be connected to the first node N1, and a second electrode may be connected to the anode electrode of the OLED. The connecting transistor M2 may connect the driving transistor Md and the OLED in response to the gate signal transmitted via the i-th gate line Gi.

In the detection transistor M3, a gate may be connected to the i-th sensor line SEi, a first electrode may be connected to the first node N1, and a second electrode may be connected to the j-th data line Dj. The detection transistor M3 may transmit the current flowing in the first node N1 to the sensor 70 via the data line Dj, in response to the sensor signal transmitted via the i-th sensor line SEi. Also, the detection transistor M3 may apply the first reference voltage Vref1, which is applied from the sensor 70, to the first node N1 via the data line Dj, in response to the sensor signal transmitted via the i-th sensor line SEi.

Referring to FIGS. 2 and 3, the first current Ij received by the first integrator 112 may be a current that is output from the driving transistor Md to the first node N1 when a voltage corresponding to a gray level (or grayscale value) of a source data signal is stored in the storage capacitor Cst and the first reference voltage Vref1 is applied to the first node N1. The switching unit 80 may connect the data line Dj with the data driver 30, and thus, a voltage that corresponds to the source data signal transmitted from the data driver 30 may be stored in the storage capacitor Cst. In this case, the switching transistor M1 is turned on, and the connecting transistor M2 and the detection transistor M3 are turned off.

The switching unit 80 may connect the data line Dj with the sensor 70, and the sensor 70 may apply the first reference voltage Vref1 via the data line Dj and the detection transistor M3. In this case, the switching transistor M1 and the connecting transistor M2 are turned off, and the detection transistor M3 is turned on.

Source-drain voltage of the driving transistor Md is determined based on a difference between the first power voltage ELVDD and the first reference voltage Vref1. Gate-source voltage of the driving transistor Md is determined based on voltages stored in the storage capacitor Cst. The driving transistor Md may generate current that corresponds to the source data signal as the first reference voltage Vref1 is applied to the first node N1. The current generated in the driving transistor Md is transmitted to the sensor 70 via the first node N1, the detection transistor M3, and the data line Dj, and the sensor 70 detects the transmitted current.

The second current Ik received by the second integrator 114 may be the current supplied by the second pixel PXik in an inactive state. For example, a source data signal corresponding to the black gray level may be applied to the second pixel PXik. For example, when the sensor 70 receives the second current Ik, a switching transistor M1 and a detection transistor M3 of the second pixel PXik may be turned off.

According to another embodiment, the first current Ij received by the first integrator 112 may be the current flowing in the OLED when the first reference voltage Vref1 is applied to the first node N1. In this case, the switching transistor M1 is turned off, and the connecting transistor M2 and the detection transistor M3 are turned on. In the OLED, the first reference voltage Vref1 may be applied to the anode electrode, and the second power voltage ELVSS may be applied to a cathode electrode. The current flows from the anode electrode to the cathode electrode in the OLED, and the current may be detected by the sensor 70 via the data line Dj.

The second current Ik received by the second integrator 114 may be the current supplied by the second pixel PXik in an inactive state. For example, when the sensor 70 receives the second current Ik, a connecting transistor M2 of the second pixel PXik may be turned off. The second pixel PXik may be disposed at a different row from the first pixel PXij so that the connecting transistor M2 of the first pixel PXij is turned on and the connecting transistor M2 of the second pixel PXik is turned on.

FIG. 4 is a schematic block diagram illustrating some components of an organic light-emitting display apparatus according to another exemplary embodiment of the present invention.

Referring to FIG. 4, the data driver 30, the sensor 70, a switching unit 80*a*, and the first and second pixels PXij and PXik. Descriptions of the data driver 30 and the sensor 70 will not be repeated.

Each of the first pixel PXij and the second pixel PXik includes the pixel circuit PC including the first node N1, and the OLED connected to the pixel circuit PC via the first node N1. Each of the first and second pixels PXij and PXik may further include the connecting transistor M2 and the detection transistor M3.

The first pixel PXij is connected to an i-th scan line Si, an i-th gate line Gi, an i-th sensor line SEi, a j-th data line Dj, and a j-th connection line Bj. The first pixel PXij may receive image data signals and source data signals via the data line Dj. The current that is output from the driving transistor Md may be transmitted to the sensor 70 via the connection line Bj. The first reference voltage Vref1 is supplied by the sensor 70 and applied to the first node N1 via the connection line Bj.

The second pixel PXik is connected to an i-th scan line Si, an i-th gate line Gi, an i-th sensor line SEi, a k-th data line Dk, and a k-th connection line Bk. The second pixel PXik may receive image data signals and source data signals via the data line Dk. The current that is output from the driving transistor Md may be transmitted to the sensor 70 via the connection line Bk. The first reference voltage Vref1 supplied by the sensor 70 may be applied to the first node N1 via the connection line Bk.

The switching unit 80*a* includes first selective switches Sw3*j* and Sw3*k* that connect the data driver 30 and the data lines Dj and Dk, and second selective switches Sw4*j* and Sw4*k* that connect the sensor 70 and the connection lines Bj and Bk. When the image data signals and the source data signals are supplied by the data driver 30 to the pixels PX via the data line Dk, a short occurs in the first selective switches Sw3*j* and Sw3*k* and the second selective switches Sw4*j* and Sw4*k* are opened. When the current that is output by the driving transistor Md is transmitted to the sensor 70 via the connection lines Bj and Bk or when the first reference voltage Vref1 supplied by the sensor 70 is applied to the first node N1 via the connection lines Bj and Bk, a short occurs in the second selective switches Sw4*j* and Sw4*k* (e.g., the second selective switches Sw4*j* and Sw4*k* are closed).

Figure 5:
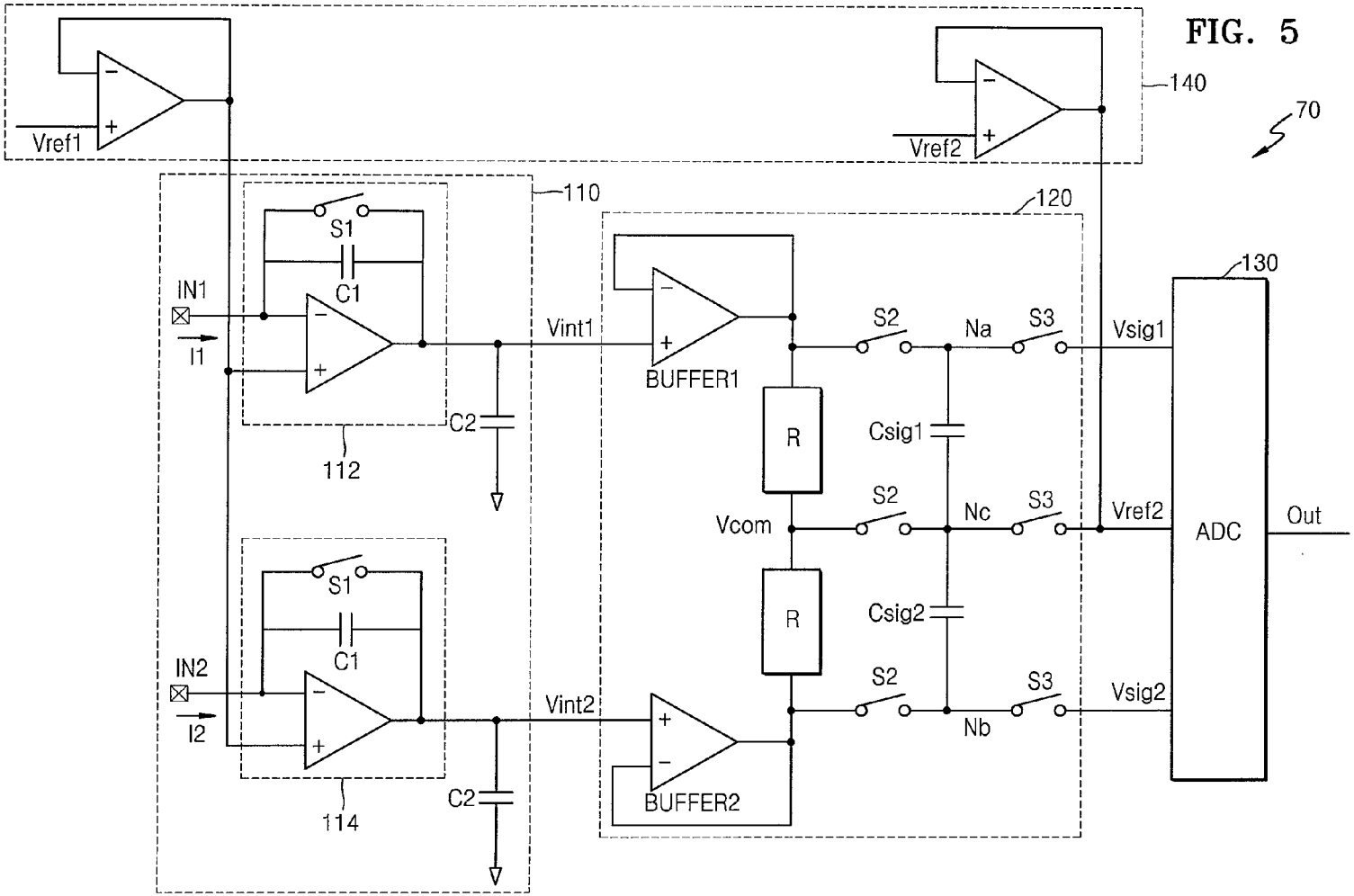
FIG. 5 is a circuit diagram of a sensor of an organic light-emitting display apparatus according to an exemplary embodiment of the present invention.

FIG. 5 is a circuit diagram of the sensor 70 of the organic light-emitting display apparatus 100 according to an exemplary embodiment of the present invention.

Referring to FIG. 5, the sensor 70 includes the current sensor 110, the level shifter 120, the ADC 130, and the reference voltage generator 140.

The current sensor 110 is configured to output a first integration voltage Vint1 corresponding to a first current I1 received in a first input terminal IN1 and a second integration voltage Vint2 corresponding to a second current I2 received in a second input terminal IN2. The first input terminal IN1 may be connected to the second selective switch Sw2*j* of FIG. 2 and the second input terminal IN2 may be connected to the second selective switch Sw2*k* of FIG. 2.

The current sensor 110 may include the first integrator 112 that outputs the first integration voltage Vint1 by integrating the first current I1 by using the first reference voltage Vref1 as an initial value, and the second integrator 114 that outputs the second integration voltage Vint2 by integrating the second current I2 by using the first reference voltage Vref1 as an initial value.

The first integrator 112 may include an operational amplifier. Regarding the operational amplifier, the first reference voltage Vref1 may be applied to a first terminal (e.g., a non-inverting terminal), and a first capacitor C1 and a first switch S1 may be connected between a second terminal (e.g., an inverting terminal) and an output terminal. When the first current I1 is received in the first input terminal IN1, the first current I1 is accumulated in the first capacitor C1, and thus voltage between two ends of the first capacitor C1 increases. Because the second terminal is fixed at the first reference voltage Vref1, a voltage Vint1 of the output terminal decreases. When the first current I1 is negative, i.e., when the first current I1 flows from the operational amplifier to the first input terminal IN1, the voltage Vint1 at the output terminal increases. An output (Vint1) of the operational amplifier may be stored in a second capacitor C2.

When a short occurs in the first switch S1 of the first integrator 112, the voltage Vint1 of the output terminal is equal to the first reference voltage Vref1. When the first switch S1 is opened, the first current I1 is integrated, and thus the voltage Vint1 of the output terminal changes. When the first current I1 is greater than 0, the voltage Vint1 of the output terminal decreases, and when the first current I1 is below 0, the voltage Vint1 of the output terminal increases. The voltage Vint1 of the output terminal of the first integrator 112 may be referred to as the first integration voltage Vint1.

As in the first integrator 112, the second integrator 114 may include an operational amplifier. In the operational amplifier, the first reference voltage Vref1 may be applied to a first terminal (e.g., a non-inverting terminal), and a first capacitor C1 and a first switch S1 may be connected between a second terminal (e.g., an inverting terminal) and an output terminal. When the second current I2 is received in the second input terminal IN2, the second current I2 is accumulated in the first capacitor C1, and thus voltage of two ends of a first capacitor C1 increases. Because the second terminal is fixed as the first reference voltage Vref1, a voltage Vint2 of the output terminal decreases. When the second current I2 is negative, i.e., when the second current I2 flows from the operational amplifier to the second input terminal IN2, the voltage Vint2 of the output terminal increases. An output (Vint2) of the operational amplifier may be stored in a second capacitor C2.

When a short occurs in the first switch S1 of the second integrator 114, the voltage Vint2 of the output terminal is equal to the first reference voltage Vref1. When the first switch S1 is opened, the first current I1 is integrated, and thus the voltage Vint2 of the output terminal changes. When the first current I1 is greater than 0, the voltage Vint2 of the output terminal decreases, and when the first current I1 is below 0, the voltage Vint2 of the output terminal increases. The voltage Vint2 of the output terminal of the second integrator 114 may be referred to as the second integration voltage Vint2.

The level shifter 120 is configured to receive the first and second integration voltages Vint1 and Vint2 from the current sensor 110, and to generate the first and second shift voltages Vsig1 and Vsig2, which respectively correspond to the first and second integration voltages Vint1 and Vint2, so that an intermediate voltage Vcom of the first and second integration voltages Vint1 and Vint2 is equal to a conversion reference voltage Vref2.

The level shifter 120 may include a voltage divider that outputs the intermediate voltage Vcom. The first and second integration voltages Vint1 and Vint2 are applied to two ends of the voltage distributor. The voltage distributor may include two resistors R that are connected in series as shown in FIG. 5. The resistors R may have identical or substantially identical resistance values. Alternatively, the voltage distributor may include first and second capacitors Csig1 and Csig2. The first and second capacitors Csig1 and Csig2 may have identical or substantially identical capacitances. In this case, the resistors R may be omitted.

The level shifter 120 may further include a first buffer BUFFER1 that copies and outputs the first integration voltage Vint1, and a second buffer BUFFER2 that copies and outputs the second integration voltage Vint2. The voltage distributor may be connected between an output of the first buffer BUFFER1 and an output of the second buffer BUFFER2.

The level shifter 120 may include the first capacitor Csig1 that stores a difference between the first integration voltage Vint1 and the intermediate voltage Vcom, and the second capacitor Csig2 that stores a difference between the intermediate voltage Vcom and the second integration voltage Vint2. The first capacitor Csig1 is connected between a first node Na and a central node Nc, and the second capacitor Csig2 is connected between the central node Nc and a second node Nb.

The level shifter 120 may include switches for applying the first integration voltage Vint1 to the first node Na, the intermediate voltage Vcom to the central node Nc, and the second integration voltage Vint2 to the second node Nb.

The conversion reference voltage Vref2 may be selectively applied to the central node Nc between the first and second capacitors Csig1 and Csig2. The conversion reference voltage Vref2 may be applied to a reference voltage terminal of the ADC 130 as a reference voltage of the ADC 130. One of the switches S3 may be connected between the central node Nc and the reference voltage terminal of the ADC 130. When a short occurs in the switches S3, the conversion reference voltage Vref2 is applied to the central node Nc. In this case, the switches S2 are opened.

The level shifter 120 may include the switches S3 for applying a voltage of the first node Na, a voltage of the central node Nc, and a voltage of the second node Nb to the ADC 130. When the switches S2 are opened and a short occurs in the switches S3, the voltage of the central node Nc is fixed to the conversion reference voltage Vref2. Thus, the voltage of the first node Na is equal to the first shift voltage Vsig1, and the voltage of the second node Nb is equal to the second shift voltage Vsig2. Therefore, the first capacitor Csig1 stores a difference between the first shift voltage Vsig1 and the conversion reference voltage Vref2, and the second capacitor Csig2 stores a difference between the conversion reference voltage Vref2 and the second shift voltage Vsig2.

The ADC 130 outputs a digital value Out that corresponds to the difference between the first and second shift voltages Vsig1 and Vsig2. The digital value Out corresponds to the current data CD. An input range of the ADC 130 is set based on the conversion reference voltage Vref2.

Figure 6A:
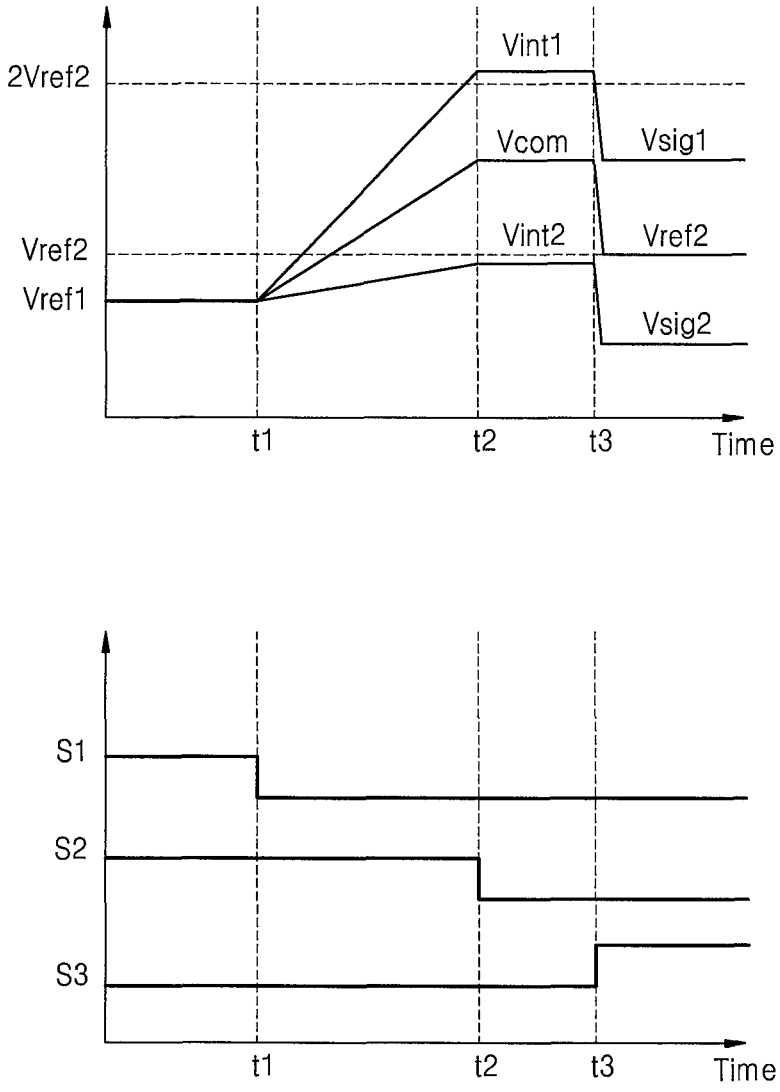
FIG. 6A is an exemplary graph illustrating operations of the sensor of FIG. 5.

FIG. 6A is an exemplary graph illustrating operations of the sensor 70 of FIG. 5.

Referring to FIG. 6A, suppose that the first current I1 and the second current I2 is below 0, and the first current I1 is less than the second current I2. When the switch S1 is opened at a first time t1, the first integrator 112 and the second integrator 114 start integrating the first current I1 and the second current I2, respectively. The first integration voltage Vint1, which is an output of the first integrator 112, increases proportionally to the first current I1, and the second integration voltage Vint2, which is an output of the second integrator 114, increases proportionally to the second current 12. In this case, because the switches S2 are short-circuited (e.g., are closed), the first integration voltage Vint1 is applied to the first node Na and the second integration voltage Vint2 is applied to the second node Nb. The intermediate voltage Vcom of the first and second integration voltages Vint1 and Vint2 is applied to the central node Nc by the voltage distributor. As shown in FIG. 6A, the first integration voltage Vint1 may exceed 2 Vref2. In this case, the current may not be accurately detected.

When the switches S2 are opened at a second time t2, the first integration voltage Vint1 and the intermediate voltage Vcom are stored at the first capacitor Csig1, and the intermediate voltage Vcom and the second integration voltage Vint2 are stored at the second capacitor Csig2.

When a short occurs in the switches S3 (e.g., when the switches S3 close) at a third time t3, the conversion reference voltage Vref2 is applied to the central node Nc, the first node Na has a potential of the first shift voltage Vsig1, and the second node Nb has a potential of the second shift voltage Vsig2. Because the first and second shift voltages Vsig1 and Vsig2 are both within the input range of the ADC 130, the ADC 130 may accurately output the digital value Out corresponding to the difference between the first and second shift voltages Vsig1 and Vsig2.

Figure 6B:
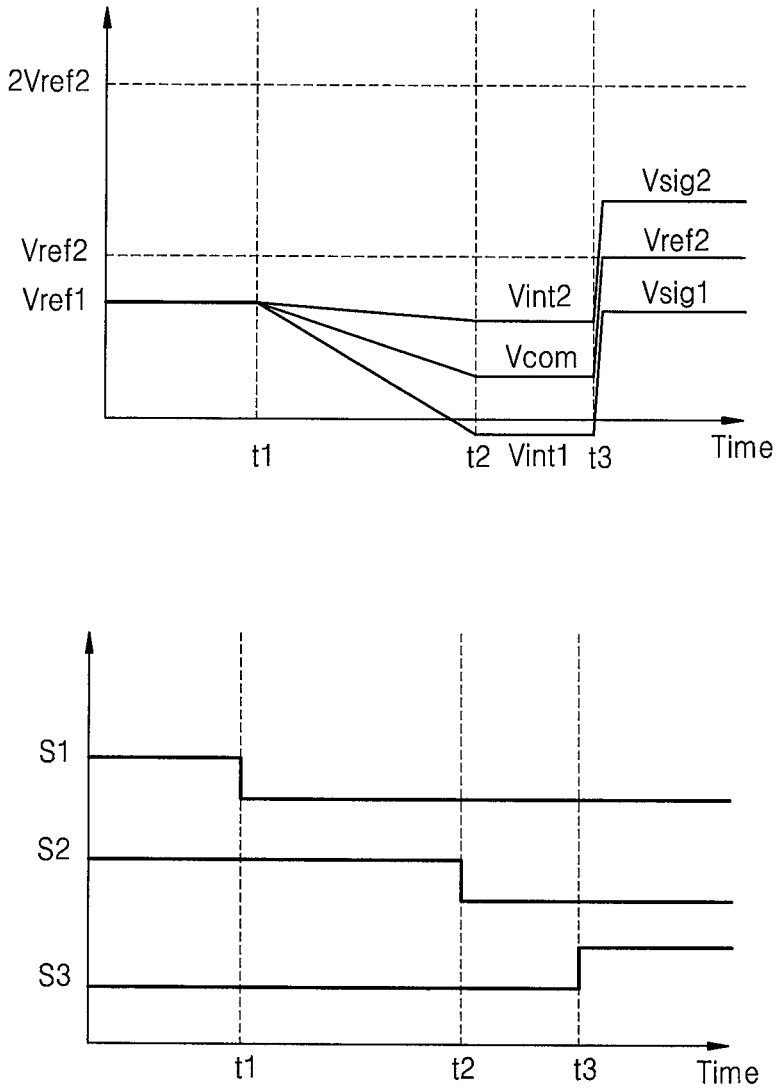
FIG. 6B is an exemplary graph illustrating operations of the sensor of FIG. 5.

FIG. 6B is an exemplary graph illustrating operations of the sensor 70 of FIG. 5.

Referring to FIG. 6B, it is assumed that the first current I1 and the second current I2 are greater than 0 and the first current I1 is greater than the second current I2. When the switch S1 is opened at a first time t1, the first integrator 112 and the second integrator 114 start integrating the first current I1 and the second current I2, respectively. The first integration voltage Vint1, which is an output of the first integrator 112, decreases proportionally to the first current I1, and the second integration voltage Vint2, which is an output of the second integrator 114, decreased proportionally to the second current I2. In this case, because the switches S2 are short-circuited (e.g., are closed), the first integration voltage Vint1 is applied to the first node Na and the second integration voltage Vint2 is applied to the second node Nb. The intermediate voltage Vcom of the first and second integration voltages Vint1 and Vint2 is applied to the central node Nc by the voltage distributor. As shown in FIG. 6B, the first integration voltage Vint1 may be below 0. In this case, the current may not be accurately detected.

When the switches S2 are opened at a second time t2, the first integration voltage Vint1 and the intermediate voltage Vcom are stored at the first capacitor Csig1, and the intermediate voltage Vcom and the second integration voltage Vint2 are stored at the second capacitor Csig2.

When a short occurs in the switches S3 at a third time t3, the conversion reference voltage Vref2 is applied to the central node Nc, the first node Na has a potential of the first shift voltage Vsig1, and the second node Nb has a potential of the second shift voltage Vsig2. Because the first and second shift voltages Vsig1 and Vsig2 are both within the input range of the ADC 130, the ADC 130 may accurately output the digital value Out corresponding to the difference between the first and second shift voltages Vsig1 and Vsig2.

Figure 7:
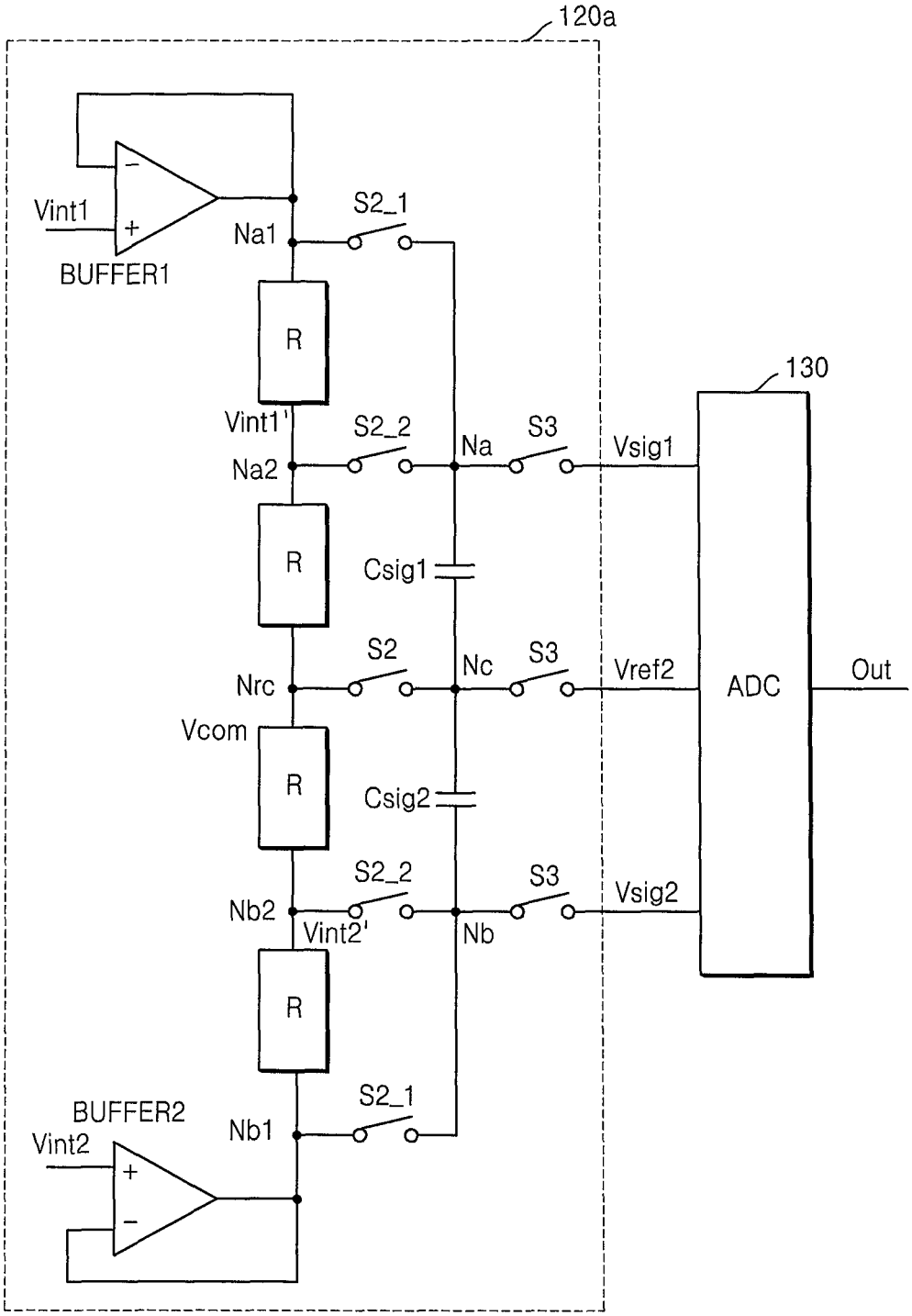
FIG. 7 is a circuit diagram illustrating a level shifter of a sensor according to another exemplary embodiment of the present invention.

FIG. 7 is a circuit diagram illustrating a level shifter 120*a* of a sensor according to another exemplary embodiment of the present invention.

Referring to FIG. 7, the level shifter 120*a* may include a voltage distributor connected between an output Na1 of a first buffer BUFFER1 and an output Nb1 of a second buffer BUFFER2. The voltage distributor may include four resistors R that have identical or substantially identical resistances and are connected in series.

The first and second integration voltages Vint1 and Vint2 are applied to two ends of the voltage distributor. A first proportional voltage Vint1' may be output from a node Na2, an intermediate voltage Vcom may be output from a central node Nrc, and a second proportional voltage Vint2' may be output from a node Nb2.

A first switch S2_1 may be connected between the output Na1 and a first node Na, and another first switch S2_1 may be connected between the output Nb1 and the second node Nb. A second switch S2_2 may be connected between the node Na2 and the first node Na, and another second switch S22 may be connected between the node Nb2 and a second node Nb. A third switch S2 may be connected between the central node Nrc and another central node Nc. A short may occur in the third switch S2 when the first switches S2_1 or the second switches S2_2 are short-circuited (e.g., are closed).

When the third switch S2 and the first switches S2_1 are short-circuited (e.g., are closed) together, the first and second integration voltages Vint1 and Vint2 are respectively applied to the first and second nodes Na and Nb. When the conversion reference voltage Vref2 is applied to the central node Nc, the first and second shift voltages Vsig1 and Vsig2 that respectively correspond to the first and second integration voltages Vint1 and Vint2 are generated, and the ADC 130 may output a digital value Out that corresponds to a difference between the first and second shift voltages Vsig1 and Vsig2. The difference between the first and second shift voltages Vsig1 and Vsig2 is equal to the difference between the first and second integration voltages Vint1 and Vint2.

When the third switch S2 and the second switches S2_2 are short-circuited (e.g., are closed) together, the first proportional voltage Vint1' and the second proportional voltage Vint2' are respectively applied to the first node Na and the second node Nb. When the conversion reference voltage Vref2 is applied to the central node Nc, the first and second shift voltages Vsig1 and Vsig2 that respectively corresponds to the first proportional voltage Vint1' and the second proportional voltage Vint2' are generated, and the ADC 130 may output a digital value Out that corresponds to a difference between the first and second shift voltages Vsig1 and Vsig2. The difference between the first and second shift voltages Vsig1 and Vsig2 is equal to the difference between the first and second proportional voltages Vint1' and Vint2'. When resistances of the resistors R are the same, the difference between the first and second shift voltages Vsig1 and Vsig2 is equal to half of the difference between the first and second integration voltages Vint1 and Vint2. Thus, the ADC 130 may have a wider input range.

As described above, according to the one or more of the above exemplary embodiments, current characteristics of an organic light-emitting display apparatus, for example, a current characteristic of a driving transistor and a current characteristic of an OLED, may be accurately detected. Therefore, colors may be accurately displayed by correcting image data or performing gamma correction according to the detected current characteristics.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims, and equivalents thereof.

What is claimed is:

1. An organic light-emitting display apparatus comprising:

a display comprising a plurality of pixels arranged in an array;

a sensor configured to detect respective current characteristics of the plurality of pixels;

a current sensor configured to receive a first current from a first pixel of the plurality of pixels, to output a first voltage corresponding to the first current, to receive a second current from a second pixel of the plurality of pixels, and to output a second voltage corresponding to the second current;

a level shifter configured to receive the first and second voltages and to generate first and second shift voltages respectively corresponding to the first and second voltages, an intermediate voltage of the first and second voltages being equal to a conversion reference voltage; and an analog-to-digital converter (ADC) configured to receive the first and second shift voltages and to output a digital value corresponding to a difference between the first and second shift voltages based on the conversion reference voltage.

2. The apparatus of claim 1, wherein each of the first and second pixels comprises a pixel circuit comprising a first node, and an organic light-emitting device (OLED) connected to the pixel circuit, and wherein the pixel circuit comprises a driving transistor configured to output a driving current to the OLED via the first node.

3. The apparatus of claim 2, wherein the first current comprises a current output from the driving transistor of the first pixel to the first node.

4. The apparatus of claim 2, wherein the first current comprises a current flowing in the OLED of the first pixel when a first reference voltage is applied to the first node of the first pixel.

5. The apparatus of claim 2, wherein the current sensor comprises a first integrator configured to integrate the first current to output the first voltage, and a second integrator configured to integrate the second current to output the second voltage.

6. The apparatus of claim 5, wherein each of the first and second integrators comprises an operational amplifier comprising a first input terminal and a capacitor, and wherein a first reference voltage is applied to the first input terminal, and the capacitor is connected between a second input terminal of the operational amplifier and an output terminal.

7. The apparatus of claim 2, wherein the level shifter comprises a first capacitor and a second capacitor, and wherein the first capacitor is configured to store a difference between the first voltage and the intermediate voltage, and the second capacitor is configured to store a difference between the second voltage and the intermediate voltage.

8. The apparatus of claim 7, wherein the conversion reference voltage is selectively applied to a node between the first and second capacitors.

9. The apparatus of claim 7, wherein the level shifter comprises a voltage distributor configured to output the intermediate voltage, and wherein the voltage distributor comprises two ends to which the first and second voltages are respectively applied.

10. The apparatus of claim 2, wherein the level shifter comprises a first capacitor and a second capacitor, and wherein the first capacitor is configured to store a difference between the first shift voltage and the conversion reference voltage, and the second capacitor is configured to store a difference between the conversion reference voltage and the second shift voltage.

11. The apparatus of claim 10, wherein the level shifter comprises a voltage distributor configured to output a first proportional voltage, the intermediate voltage, and a second proportional voltage, wherein the voltage distributor comprises two ends to which the first and second voltages are respectively applied, and wherein a difference between the first proportional voltage and the intermediate voltage is stored in the first capacitor, and a difference between the intermediate voltage and the second proportional voltage is stored in the second capacitor.

12. The apparatus of claim 2, wherein an input range of the ADC is set based on the conversion reference voltage.

13. The apparatus of claim 2, further comprising a reference voltage generator configured to generate a first reference voltage applied to the first node and the conversion reference voltage.

14. The apparatus of claim 13, wherein the sensor comprises the current sensor, the level shifter, the ADC, and the reference voltage generator.

15. The apparatus of claim 2, wherein the display further comprises a plurality of data lines connected to the plurality of pixels, and wherein the current sensor is configured to receive the first and second currents via corresponding ones of the data lines connected to the first and second pixels.

16. The apparatus of claim 15, further comprising:

a data driver configured to supply data signals to the plurality of pixels via the plurality of data lines; and a switching unit comprising first switches connected between the data driver and the plurality of data lines, and second switches connected between the sensor and the plurality of data lines.

17. The apparatus of claim 1, wherein the second pixel is in an inactive state and the second current comprises a noise component.

18. An organic light-emitting display apparatus comprising:

a current sensor configured to output a first integration voltage corresponding to a first current received at a first input terminal and a second integration voltage corresponding to a second current received at a second input terminal;

a level shifter configured to receive the first and second integration voltages and generate first and second shift voltages respectively corresponding to the first and second integration voltages, an intermediate voltage of the first and second integration voltages being equal to a conversion reference voltage; and an analog-to-digital converter (ADC) configured to receive the first and second shift voltages and to output a digital value corresponding to a difference between the first and second shift voltages based on the conversion reference voltage.

19. The apparatus of claim 18, wherein the current sensor comprises a first integrator configured to integrate the first current based on a first reference voltage as an initial value and to output the first integration voltage, and a second integrator configured to integrate the second current based on the first reference voltage as an initial value and to output the second integration voltage.

20. The apparatus of claim 19, further comprising a reference voltage generator configured to generate the first reference voltage and the conversion reference voltage.

* * * * *